US008367986B2

(12) United States Patent
Von Wachenfeldt et al.

(10) Patent No.: US 8,367,986 B2
(45) Date of Patent: Feb. 5, 2013

(54) HEATING ELEMENT

(75) Inventors: Fredrik Von Wachenfeldt, Banten (ID); Per-Göran Mikael Mortenson, Hägersten (SE); Gunnar Nyberg, Täby (SE); Lars-Ove Nilsson, Kvicksund (SE); Joachim Sjöstrand, Solna (SE)

(73) Assignee: Conflux AB, Solna (SE)

( * ) Notice: Subject to any disclaimer, the term of this patent is extended or adjusted under 35 U.S.C. 154(b) by 645 days.

(21) Appl. No.: 12/446,187

(22) PCT Filed: Oct. 5, 2007

(86) PCT No.: PCT/SE2007/050714

§ 371 (c)(1),
(2), (4) Date: Feb. 22, 2010

(87) PCT Pub. No.: WO2008/048176

PCT Pub. Date: Apr. 24, 2008

(65) Prior Publication Data

US 2010/0320191 A1 Dec. 23, 2010

Related U.S. Application Data

(60) Provisional application No. 60/829,680, filed on Oct. 17, 2006.

(30) Foreign Application Priority Data

Oct. 17, 2006 (SE) ..... 0602172

(51) Int. Cl.
*H05B 3/10* (2006.01)

(52) U.S. Cl. ..... 219/548; 219/510; 219/528; 219/540; 219/505; 219/549; 219/553; 29/612; 29/610.1; 252/511; 252/500; 338/22 R; 338/22 SD; 338/203; 338/235

(58) Field of Classification Search ..... 29/612, 29/610.1; 219/510, 528, 540, 505, 548, 549, 219/553; 252/511, 500; 338/22 R, 22 SD, 338/203, 235

See application file for complete search history.

(56) References Cited

U.S. PATENT DOCUMENTS (Continued)

FOREIGN PATENT DOCUMENTS

CN 1124869 A 6/1996
CN 1137185 C 2/2004

(Continued)

OTHER PUBLICATIONS

International Search Report corresponding to PCT/SE2007/050714 mailed Jan. 25, 2008.

(Continued)

*Primary Examiner* — Meiya Li
(74) *Attorney, Agent, or Firm* — Renner, Otto, Boisselle & Sklar, LLP

(57) ABSTRACT

A positive temperature coefficient (PTC) superimposed impedance polymeric (SIP) compound including an electrically insulating matrix essentially consisting of a siloxane polymer in addition to first and second electrically conductive particles having different properties with respect to surface energies and electrical conductivities. A multi-layered, ZPZ, foil including a PTC SIP compound of the invention present between two metal foils, thereby forming a conductive composite body. A multi-layered device, including an essentially flat composite body made up from a PTC SIP compound according to the invention, two electrode layers adhering to the surfaces of the composite body, the electrode layers being metal foils prepared to connect to electrodes.

21 Claims, 3 Drawing Sheets

U.S. PATENT DOCUMENTS

| | | | | |
|---|---|---|---|---|
| 4,177,376 | A | 12/1979 | Horsma et al. | |
| 4,330,703 | A | 5/1982 | Horsma et al. | |
| 4,543,474 | A | 9/1985 | Horsma et al. | |
| 4,654,511 | A | 3/1987 | Horsma et al. | |
| 5,057,674 | A | 10/1991 | Smith-Johannsen | |
| 6,104,587 | A | 8/2000 | Banich et al. | |
| 2002/0093007 | A1* | 7/2002 | Handa et al. | 252/500 |
| 2003/0121141 | A1* | 7/2003 | Chu et al. | 29/612 |

FOREIGN PATENT DOCUMENTS

| | | | |
|---|---|---|---|
| EP | 0 435 574 | A2 | 7/1991 |
| JP | S63-170902 | | 7/1988 |
| JP | H04-039814 | A | 2/1992 |
| JP | H08-102216 | A | 4/1996 |
| JP | 2002-241554 | A | 8/2002 |
| JP | 2003-217902 | A | 7/2003 |
| JP | 2005-064090 | A | 3/2005 |

OTHER PUBLICATIONS

Written Opinion corresponding to PCT/SE2007/050714 mailed Jan. 25, 2008.

Chinese Office Action in corresponding Chinese Patent Application No. 200780038406 mailed Sep. 17, 2012 and English translation.

English translation of Japanese Office Action in corresponding Japanese Patent Application No. 2009-533279 mailed Sep. 18, 2012.

Peng et al., "Effect of Carbon Black Blend with Different Particle Size on PTC Properties of Conductive Polymer Composite", Journal of Functional Polymers, No. 2, pp. 229-232, 2003, English translation of Abstract provided.

* cited by examiner

Volume resistivity [Ωcm]

$10^8$
$10^7$
$10^6$
$10^5$
B
C
D
E
F
A
Temperature [C]
RT
2RT
3RT
4RT
5RT
6RT

HEATING ELEMENT

FIELD OF THE INVENTION

A positive temperature coefficient, PTC, superimposed impedance polymeric, SIP, compound, a multi-layered, zero-positive-zero temperature coefficient, ZPZ, foil and a multi-layered device comprising a multi-layered ZPZ foil comprising a PTC SIP compound.

BACKGROUND OF THE INVENTION

Several types of self limiting electrical heating elements are known from, e.g., German patent No. 2,543,314 and the corresponding U.S. Pat. Nos. 4,177,376, 4,330,703, 4,543,474, and 4,654,511.

Further, U.S. Pat. No. 5,057,674 describes such an element comprising two outer semiconductive layers allegedly having a zero temperature coefficient ("ZTC") separated from one another by a continuous positive temperature coefficient ("PTC") layer and energized by two parallel electrodes, the first one being in contact with one end of one of the ZTC layers and the second parallel electrode being in contact with the other ZTC layer at its end furthest removed from the first electrode.

According to U.S. Pat. No. 5,057,674 the components of the layered structure are such that at room temperature, the resistance in the PTC layer between the ZTC layers is very much less than the resistance in the combined ZTC layers, which in turn is very much less than the resistance in the PTC layer between the electrodes. Further, at control temperature the resistance in the PTC layer between the parallel ZTC layers should be equal to the resistance in the parallel ZTC layers, the geometry being such that at the control temperature where the resistances of the two components are equal, the heat generated per time and unit area (the power densities) are also essentially equal.

The PTC layer at room temperature acts as a short circuit between the parallel ZTC layers. The resistance between the electrodes in the PTC layer is very high when a voltage is at first applied and the ZTC layers alone develop heat, this is a result of the geometry. However, as the temperature rises the resistivity in the PTC layer increases until it is equal to that of the combined ZTC layers. Slightly above this temperature the two ZTC layers act as electrodes and heat is generated uniformly throughout the system, and any further rise in temperature anywhere in the area of the ZTC layers effectively reduces or shuts off the current. In this way the PTC component acts almost only as a control, and the ZTC components perform as the active heating elements.

Also according to this patent the polymer matrix is essentially crystalline, the given example being polyethylene (PE) and ethylene vinyl acetate (EVA).

A problem with both this heating element and earlier such elements based on electrically conductive wires threaded through an electrically conductive body is that a small physical damage in the element, such as a hole, will shut off the electrical current and thereby the function of the element.

A further problem is that most known PTC materials comprise conductive particles such as carbon black in a crystalline polymer matrix. When the material is heated it expands and the resistivity increases as the gaps between conductive particles and between particle clusters increase. At approximately the polymer melting point a sharp rise in resistivity is obtained, the material "trips", when the polymer softens and melts. This effect is due, not only to increasing distances between particles, but also to the movement of the particles and particle clusters in the melt and the breaking up of particle clusters obtained by the increased energy and movement of the particles within the clusters. On account of these considerable changes within the material, it shows a strong hysteresis effect, and hence the material will not return to its original properties after cooling. Further, as the tripping event is linked to the polymer melting point, it is difficult to adjust the level of the trip temperature.

OBJECTS OF THE INVENTION

An object of the invention is to achieve a positive temperature coefficient, PTC, material suitable for use in a heating element.

Another object is to achieve a PTC material having a composition adapted to give a desired constant temperature in a heating element.

It is also an object to achieve a PTC material having a composition that may give a constant temperature between 25 and 170° C.

A further object is to achieve a heating element which is not sensitive to physical damages and may hold a constant temperature which can be set to fit the intended application.

A further object is to achieve a very thin heating element that may be cut to fit different applications.

It is also an objective of the invention to achieve a heating element suitable for an AC or DC voltage between about 3 and 240 V, such as between about 3 and 230 V, especially for an AC or DC voltage at about 5, 6, 24, 48, 110 or 220 V, preferably 4.8, 7.2, 12, 24, 48, 60, 120 or 240V.

Another objective is to achieve a heating element that may pass through several heating cycles without essentially changing properties.

SUMMARY OF THE INVENTION

The problems to the prior art are overcome by the invention. According to a first feature the invention concerns a PTC material which is a PTC SIP compound comprising an electrically insulating matrix essentially consisting of an amorphous polymer, and containing first and second electrically conductive particles having different properties, the PTC SIP compound, thereby forming a conductive network. The SIP name indicates that there are involved two kinds of conductive particles, one representing a PTC component superimposed on another representing a component with a constant temperature coefficient ("CTC").

According to a second feature the invention concerns a multi-layered ZPZ foil comprising a layer of a PTC SIP compound of the invention between two metal foil layers. The ZPZ name indicates that there are involved two layers having essentially a zero temperature coefficient encapsulating a third layer having essentially a positive temperature coefficient.

According to a third feature the invention concerns a multi-layered device, such as a heating element, having an intermediate layer of PTC SIP compound between two metal foils. Opposite to previously known suchlike devices the electric current will pass through the PTC SIP compound in the z-direction, perpendicular to the layered structure. Thereby a small damage in the layer will not affect the functionality. The current may still pass from one metal foil to the other in the undamaged parts of the multi-layered ZPZ foil structure.

Further, with a proper choice of materials the present multi-layered device may be very thin.

DETAILED DESCRIPTION OF THE INVENTION

Figure 1A:
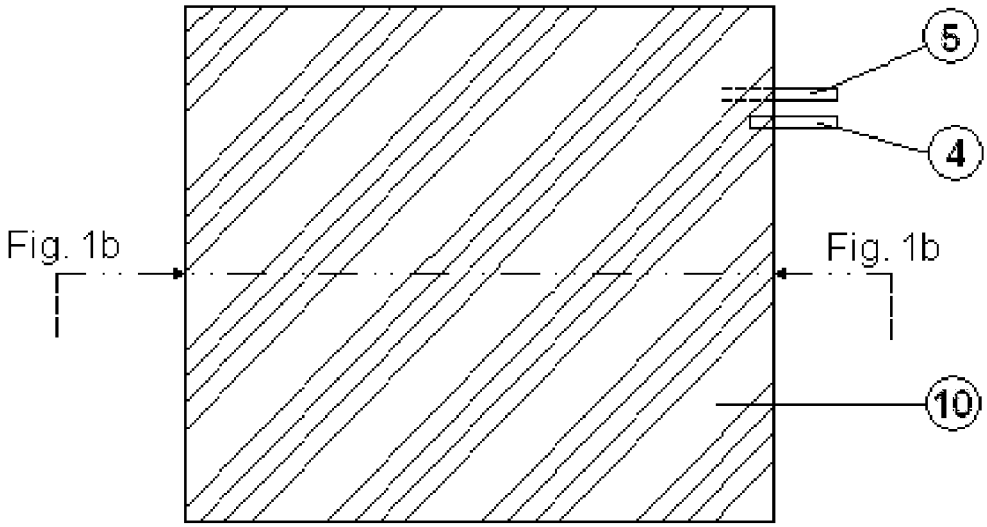
FIGS. 1*a* and 1*b* represent schematic views of one embodiment of a heating element according to the invention, looked at from above and in cross section.

The invention concerns according to the first feature a PTC SIP compound comprising an electrically insulating matrix essentially consisting of an elastomer (elastomeric polymer), first and second electrically conductive particles having different properties with respect to surface energies and electrical conductivities, the material thereby forming a conductive network. The first and second electrically conductive particles dispersed in the matrix may consist of carbon blacks having different surface energies and structural morphologies.

The elastomer in the present PTC SIP compound is completely amorphous and therefore does not experience the problems present in crystalline polymer PTC materials. Further, the increase in resistivity in the trip temperature regime is mainly due to the properties of the electrically conductive particles, rather than by any increase in volume expansion coefficient of the elastomer nor by any phase change.

The elastomer may be any suitable amorphous polymer having no tendency to crystallize below the desired trip temperature and having a low enough glass transition temperature. It may be selected from the group consisting of chlorinated polyethylene, chlorosulfonated polyethylene, neoprene, nitrile rubber and ethylene-propylene rubber. The polymer is preferably based on a siloxane elastomer (often called silicone elastomer) where the polymer backbone may have substituents such as halogenes, for example polyfluorosiloxane. Especially preferred is a polydimethylsiloxane elastomer.

The elastomeric polymer matrix contains at least two types of electrically conductive particles. The conductive particles may comprise two types of carbon blacks where one is a CTC type, i.e. giving rise to essentially a constant temperature coefficient, and the other is a PTC type. Further, fumed silica particles may be used as filler in the polymer matrix.

Preferably the first electrically conductive particles comprise thermal carbon blacks having low surface area and low structure, for example medium thermal carbon blacks, and the second electrically conductive particles comprise furnace carbon blacks having higher structures and higher specific surface areas, such as fast extrusion furnace blacks.

The thermal carbon black has a mean particle size of at least 200 nm, preferably in the range of 200-580 nm, typically of about 240 nm. It has suitably a specific surface area determined by nitrogen absorption of about 10 $m^2/g$.

The furnace carbon black has a particle size distribution in the range of 20-100 nm, preferably in the range of 40-60 nm and typically in the range of 40-48 nm. It has a specific surface area determined by nitrogen absorption in the range of 30-90 $m^2/g$ , preferably of about 40 $m^2/g$ The PTC SIP compound may comprise 3.6-11% by weight of the furnace carbon black, 35-55% by weight, preferably 35-50% by weight, of the thermal carbon black, at least 2, preferably at least 5% by weight, and at most 13, preferably at most 10% by weight of a fumed silica filler and between 35 and 48% by weight siloxane elastomeric polymer. It may also comprise 0.36-5.76% by weight of one or more coupling agents, based on the weight of the furnace carbon black.

The PTC SIP compound may have a volume resistivity at room temperature in the range of 10 kΩcm to more than 10 MΩcm depending on the composition. A PTC SIP compound to be used in a heating element being a multi-layered device, according to the invention should preferably have a volume resistivity of at least 0.1 MΩcm.

The trip temperature of the PTC SIP compound of the invention may be set a value within the range of 25 to 170° C. by adjusting the composition of the PTC SIP compound.

According to the second feature the invention concerns a multi-layered ZPZ foil comprising a PTC SIP compound present between a first essentially planar metal foil and a second essentially planar metal foil, wherein the PTC SIP compound includes an electrically insulating matrix consisting essentially of an elastomeric amorphous polymer, and first and second electrically conductive particles, dispersed therein, the composite body thereby forming a conductive network extending from the first metal foil to the second metal foil, wherein the first and second electrically conductive particles have different surface energies and electrical conductivities.

Suitably the amorphous polymer comprises a siloxane polymer.

Preferably the composite body comprises a PTC SIP compound according to the first feature of the invention.

The multi-layered ZPZ foil may be in the form of an essentially endless web. The multi-layered ZPZ foil may also have the size and form suitable for a device according to the third feature of the invention.

Further, the present invention relates to a multi-layered ZPZ foil wherein the thickness of the composite body may be less than 400 μm, preferably in the range of 100-300 μm.

The multi-layered ZPZ foil has an intermediate layer which may minimize contact resistance.

The intermediate layer may comprise an electrochemical pre-treatment, wherein the pre-treatment is carried out by electrochemical means.

According to the third feature the invention concerns a multi-layered device comprising an essentially two-dimensional composite body having a first surface and a second surface opposite to the first surface, and including an electrically insulating matrix consisting of a polymer and containing electrically conductive particles, wherein the matrix essentially consists of an elastomeric amorphous polymer containing first and second electrically conductive particles dispersed therein, the composite body thereby forming a conductive network extending from the first surface to the opposite second surface of the composite body, and the first and second electrically conductive particles having different surface energies and electrical conductivities, wherein an electrode layer adheres to each of the surfaces of the composite body, each of the electrode layers consisting of a metal foil, the metal foils being prepared for connection to electrodes carrying electrical current through the composite body in a direction essentially perpendicular to the electrode layers.

The amorphous polymer may be a siloxane polymer as also for the compound and the foil.

Preferably the two-dimensional composite body comprises a PTC SIP compound present in a multi-layered ZPZ foil of the invention.

The multi-layered device may further comprise electrodes connected to the electrode layers to facilitate connection to a power supply.

The volume resistivity of the composite body in the heating element is preferably of an order of magnitude exceeding 0.1 MΩcm.

The invention further relates to a multi-layered device wherein the thickness of the composite body is less than 400 μm, preferably in the range of 100-300 μm.

The multi-layered device may comprise further layers outside the metal foils, such as polymer layers intended to electrically insulate and protect the metal foils.

Further, the multi-layered device may comprise an intermediate layer formed at an interface located between the composite body and each of the two metal foils, the intermediate layer comprising an electrochemical pre-treatment. The intermediate layer should preferably minimize contact resistance between the composite body and the metal foils. The pre-treatment may be carried out by electrochemical means.

The multi-layered ZPZ foil to be used in the composite body may be in the form of a very long, essentially endless web that may be cut to any size and shape before use.

The multi-layered device may be used as heating elements in for example heaters for; motorbike vests, freight containers, wind turbine rotor blades, convection type radiators, aircraft wing leading edge de-icing, pipe tracing, non-resettable fuse temperature hold, wash-room mirrors, toilet seats, food box warm keeping, pet baskets, bath-room towel racks, automotive- and truck external mirror glasses, comfort- and rescue blankets, outdoor liquid crystal display (LCD) panels, radio masts, surgery tables, breathing machine filters, human artificial implants, work shoes, chain-saw-handles and ignitions, outdoor cellular infrastructure amplifier- and rectifier enclosures, water pipe de-icing, road vehicle lead-acid batteries or comfort heated floor-modules. In this case the trip temperature of the PTC SIP compound may be adjusted to in between 25 and 170° C., preferably between in 40 and 140° C.

The present invention also relates to a multi-layered device that is a ski lift seat heater having a trip temperature between 40 and 70° C., a traffic mirror heater having a trip temperature between 40 and 70° C., a ski boot heater having a trip temperature between 40 and 70° C., a liquid filled radiator heating element having a trip temperature between 70 and 140° C. or a fuel container liquid level sensor having a trip temperature between 40 and 70° C.

The present invention also relates to a multi-layered device wherein the voltage applied is a DC or AC voltage in the range of about 3-240 V, preferably at about 4.8, 7.2, 12, 24, 48, 60, 120 or 240 V.

The invention is described in more detail in the following examples and in the enclosed drawings.

Figure 1B:
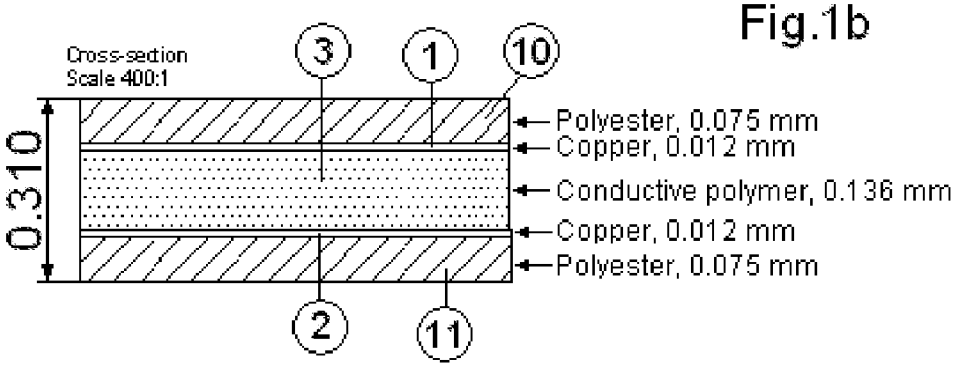

FIGS. 1*a* and 1*b* show an insulated multi-layered ZPZ foil according to the invention which may be used as seat heater. The element comprises two 0.012 mm thick copper foils 1, 2 adhering to a 0.136 mm thick layer 3 of conductive PTC polymer sandwiched between the copper foils 1, 2. Outside each copper foil there is an insulating, 0.075 mm thick polyester layer 10, 11. Two electrode strips 4, 5 are arranged on the copper foils 1, 2, respectively, forming terminal leads.

Figure 2A:
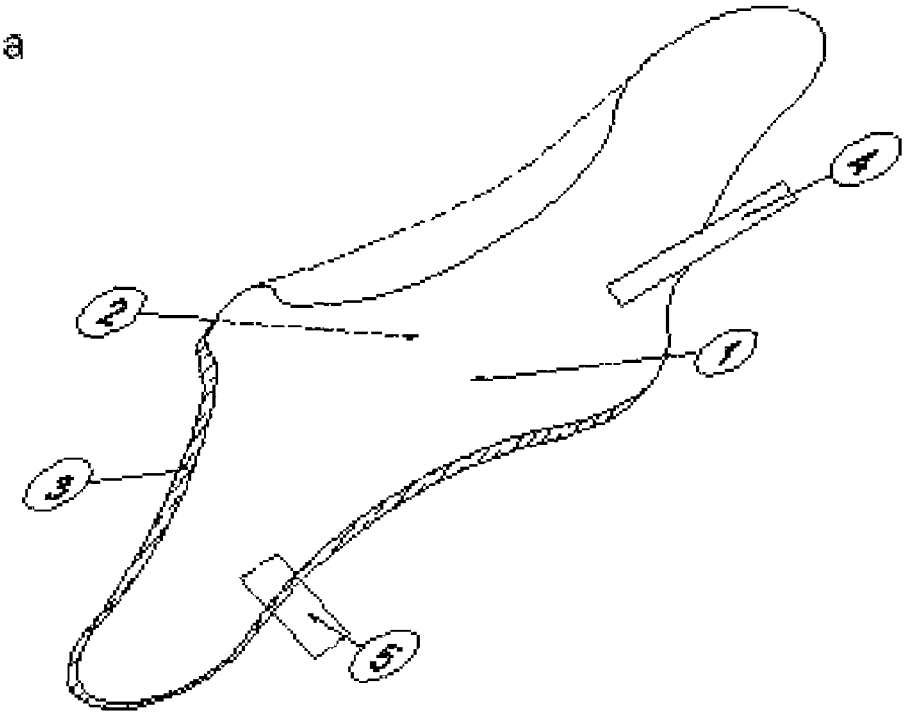
FIGS. 2*a* and 2*b* represent schematic perspective views of two other embodiments of the heating element invention.
Figure 2B:
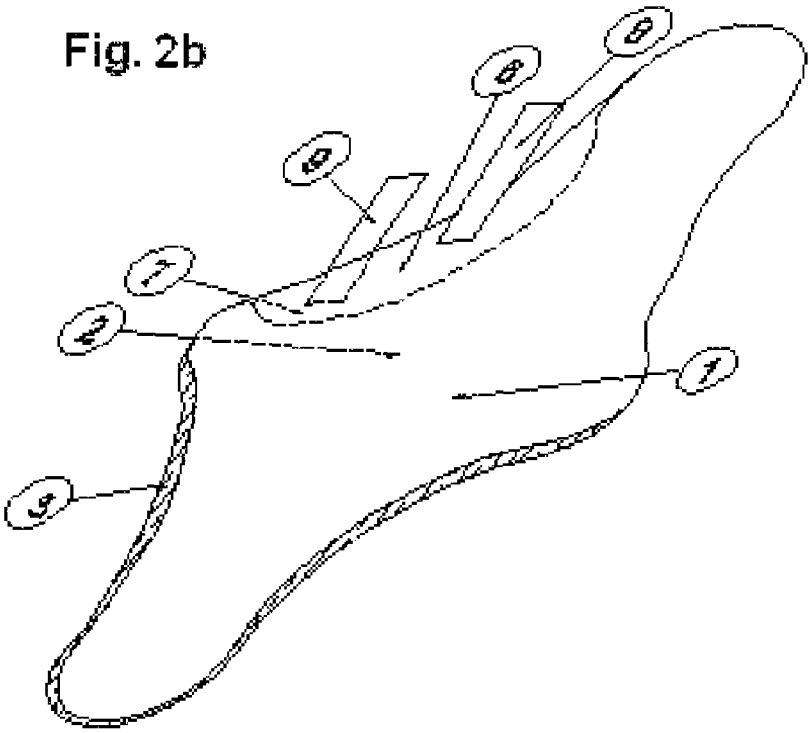

FIGS. 2*a* and 2*b* show different embodiments of multi-layered ZPZ foils according to the invention to be used in heating elements. The size and shape of the two multi-layered ZPZ foils are essentially the same. The dashed line on FIG. 2*a* shows the outer perimeter of the multi-layered ZPZ foil in FIG. 2*b* where it differs from the multi-layered ZPZ foil in FIG. 2*a*. On the other hand, the dashed line on in FIG. 2*b* shows the outer perimeter of the multi-layered ZPZ foil in FIG. 2*a* where this differs from the multi-layered ZPZ foil in FIG. 2*b*.

The multi-layered ZPZ foils both comprise a top metal layer 1, a bottom metal layer 2 and an intermediate PTC SIP compound layer 3. The multi-layered ZPZ foil in FIG. 2*a* has a top metal terminal lead 4 and a bottom metal terminal lead 5.

Instead of the leads 4 and 5 the multi-layered ZPZ foil in FIG. 2*b* comprises a top metal terminal lead 8 and a bottom metal terminal lead 9 attached to the extended parts 6, 7 of the top metal layer and bottom metal layer, respectively.

Heating elements of such different shapes, geometries and sizes may easily be cut from a multi-layered ZPZ foil of the invention. Further, as is shown in FIGS. 2*a* and 2*b*, the metal leads may indiscriminately connect anywhere to the top and bottom metal foils.

Figure 3:
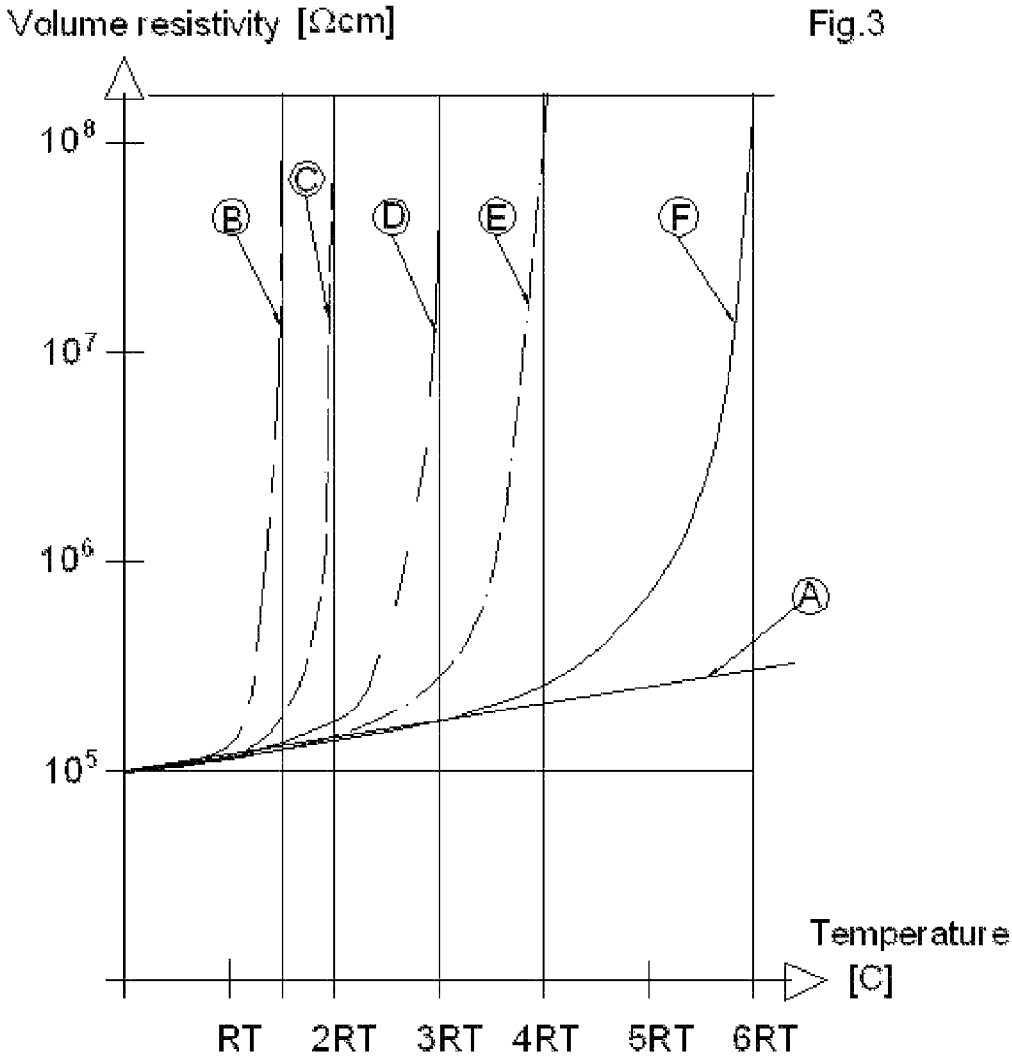
FIG. 3 shows a graphic representation of the relation between volume resistivity and temperature for different PTC SIP compounds according to the invention.

FIG. 3 shows a diagrammatic representation of the relation between temperature and volume resistivity for a siloxane polymer containing different proportions of carbon black particles and fillers. (A) is a siloxane polymer containing only the CTC powder described in the following examples. (B) and (D) correspond to the PTC SIP compounds described in the following example 2 and example 1, respectively. (C), (E) and (F) correspond to other embodiments of the PTC SIP compound of the invention.

EXAMPLES

In both examples the following materials were used:

PDMS—polydimethyl siloxane,

CB MT—a medium size carbon black, Thermax Stainless Powder N-908 from Cancarb Ltd, Canada;

CB FEF—a fast extrusion furnace black, Corax® N 555 from Degussa AG, Germany;

Silica—Aerosil® 200, hydrophilic fumed silica and a coupling agent which is a vinylmethoxysiloxane homooligomer with a molecular weight of 500-2500 from Gelest, Inc.

Thermax Stainless Powder N-908 has low surface area and low structure. It is inactive as regards surface chemistry and relatively free of organic functional groups and therefore shows very high chemical and heat resistance. It consists of uniform, soft pellets that are non-pelletizing. The mean particle diameter is 240 nm. It is easily dispersed in the polymer matrix.

Corax® N 555, on the other hand, is a semi-active carbon black with high structure. It has a particle size distribution between 40 and 48 nm, the arithmetic mean particle diameter being 46.5 nm. The particles form large aggregates visible to the naked eye. The powder has a high inherent specific conductivity. It imparts a high viscosity to the polymer matrix.

Example 1

The following polymer compound material was prepared, the percentages being based on the weight of the complete composition:

| | |
|---|---|
| 1. PDMS | 46.5% |
| 2. CB MT (CTC powder) | 41.2% |
| 3. CB FEF (PTC powder) | 5.2% |
| 4. Silica | 7.2% |

Further 0.36% by weight of the coupling agent based on the weight of the PTC powder.

The silica is a necessary filler to rheologically stabilize the matrix and increase the distance between carbon particles.

The powder fractions are sieved, the liquid coupling agent is added and the mixture is ultrasonically treated. All components are compounded to a stiff material that is laminated between copper foils. The laminate is heat treated at approximately 130° C. for 24 hours, where after curing is performed by irradiation with electron-beams into the compounded material, through the metal foils. The obtained silicone matrix is nearly completely crosslinked to form one sole molecule.

The obtained material has a trip temperature of about 45° C.

A multi-layered ZPZ foil structure of a 0.136 mm thick layer of conductive polymer surrounded by two copper foils of a thickness of 0.012 mm was connected to a power source supplying an AC or DC voltage of 48 V via two electrode strips on the copper foils (see enclosed FIG. 1). The layered structure was cooled to a temperature of −22° C. before switching on the power. The temperature rose to +45° C. within 17 seconds. The maximum equilibrium temperature was +65° C.

Switching the power on and off in cycles gives the same trip and equilibrium temperatures.

Example 2

The following polymer compound material was prepared, the percentages being based on the weight of the complete composition:

| | |
|---|---|
| 1. PDMS | 43.2% |
| 2. CB MT (CTC powder) | 50.0% |
| 3. CB FEF (PTC powder) | 4.5% |
| 4. Silica | 2.4% |

Further 0.36% by weight of the coupling agent based on the weight of the PTC powder.

The PTC SIP compound was prepared in the same way as in example 1.

The obtained composite body has a trip temperature of about 40° C.

A multi-layered ZPZ foil structure comprising a 0.074 mm thick layer of PTC SIP compound present in between two copper foils of a thickness of 0.012 mm was connected to a power source supplying an AC or DC voltage of 12 V via two electrode strips on the copper foils. The layered structure was cooled to a temperature of −15° C. before switching on the power. The temperature rose to 5° C. within 30 seconds. The maximum equilibrium temperature was 35° C.

The trip temperature and maximum equilibrium temperature may be adjusted by changing 1) the proportions of PTC powder and CTC powder, 2) the proportion of silica, 3) the proportion of coupling agent, 4) the irradiation dose and 5) the irradiation temperature.

The PTC SIP compound of the invention is a completely new type of PTC SIP compound. Earlier polymeric PTC materials are based on crystalline polymers or a mixture of crystalline polymers and elastomeric polymers containing electrically conductive particles of PTC type. The steep rise in resistance is obtained by a thermal expansion of the polymer matrix followed by a phase change at the melting point. At this point the conductive paths through the polymer are disrupted by movement of the particles in the melt and by breaking up of particle agglomerates. As the polymer cools below the melting point not all conductive paths are restored.

Oppositely, the present PTC SIP compound comprises a small proportion of 1) small conductive particles (PTC powder) which form large clusters and agglomerates and have a high conductivity, and a large proportion of 2) large conductive particles (CTC powder) not forming clusters and having a relatively low conductivity. The CTC powder as well as the silica filler are important as to adjusting the rheological properties of the PTC SIP compound.

When the material is heated it does not undergo any phase change. A small expansion is obtained. However, the important change in conductivity is obtained by the increasing mobility of the conductive particles when heated. Thanks to the inherent low specific conductivity of the CTC powder, this powder provides a resistance base with low conductivity, although present in large amounts in the polymer. This conductivity decreases slowly as shown by the straight line (A) in the diagram in FIG. 3.

The PTC powder on the other hand provides conductivity by means of the high inherent specific conductivity of the particles which by large clusters form conductive paths through the polymer. The clusters require considerable energy before becoming mobile. However, when finally becoming mobile, they swiftly disrupt the conductive paths and the remaining conductivity is the slowly decreasing basic conductivity formed by the CTC powder. Eventually this disappears at a higher temperature, the equilibrium temperature.

As the polymer matrix does not undergo any phase change a return to lower temperatures swiftly restores the original conductivity.

The trip and maximum temperature of the PTC SIP compound may be adjusted by changing the proportions between PTC powder and CTC powder, a higher proportion of PTC powder generally giving a higher trip temperature. Further, surface treatment of the PTC agglomerates may influence the trip temperature. A stronger bond of the PTC powder to the elastomeric matrix by the use of a higher amount of coupling agent may also increase the trip temperature. However, too much PTC powder and coupling agent may result in loss of the PTC characteristics.

Should a multi-layered device of the invention, such as a seat heater, be damaged in use by short-circuiting the metal layers, a through-hole will be burnt across the heater. However, the edges of the metal foils at the through-hole will melt so that the metal edges retract from the hole and the metal layers no longer make contact one to the other. The heater will resume its function, except in the damaged part, as the electric current pass in the z-direction between the metal layers. In a prior art seat heater where the electric current is carried by metal threads or through printed layers on top of the conductive polymer, such a damage will disrupt the electric current permanently and make the heater unserviceable.

The invention has been described above with reference to specific examples. These examples are not intended to limit the scope of the invention. This scope is only defined by the following claims.

The invention claimed is:

1. A positive temperature coefficient (PTC), superimposed impedance polymeric (SIP) compound comprising:

an electrically insulating matrix consisting essentially of an amorphous polymer, and a first and second types of electrically conductive particles, the second types having a different surface energy and a different electrical conductivity than a surface energy and an electrical conductivity of the first type, said first and second types of electrically conductive particles dispersed within said electrically insulating matrix, whereby the PTC SIP compound becomes a conductive composite body.

2. A PTC SIP compound according to claim 1 wherein the amorphous polymer is a siloxane polymer.

3. A PTC SIP compound according to claim 1 having a trip temperature between 25 and 170° C.

4. A PTC SIP compound according to claim 1 wherein the first and second types of electrically conductive particles are present in a total amount exceeding 35% by weight based on the weight of the compound.

5. A PTC SIP compound according to claim 1, wherein the first type of electrically conductive particles comprises carbon blacks having a first surface energy and first structural morphology and the second type of electrically conductive particles comprises carbon black having a second surface energy and second structural morphology.

6. A PTC SIP compound according to claim 5, wherein the first type of electrically conductive particles comprises a thermal carbon black having low specific surface area and low structure and the second type of electrically conductive particles comprises a furnace carbon black having high structure and high specific surface area.

7. A PTC SIP compound according to claim 6, wherein the thermal carbon black of the first type of electrically conductive particles has a mean particle size of at least 200 nm.

8. A PTC SIP compound according to claim 6, wherein the thermal carbon black of the first type of electrically conductive particles has a specific surface area determined by nitrogen absorption of about 10 $m^2/g$.

9. A PTC SIP compound according to claim 6, wherein the furnace carbon black of the second type of electrically conductive particles has a particle size distribution within the range of 20-100 nm.

10. A PTC SIP compound according to claim 6, wherein the furnace carbon black of the second type of electrically conductive particles has a specific surface area determined by nitrogen absorption of 30-90 $m^2/g$.

11. A PTC SIP compound according to claim 6, comprising 3.6-11% by weight of the furnace carbon black, 35-55% by weight of the thermal carbon black, and 48% by weight siloxane elastomeric polymer, and further comprising 2-13% by weight of a fumed silica filler.

12. A PTC SIP compound according to claim 11, further comprising 0.36-5.76% by weight coupling agent, based on the weight of the furnace carbon black.

13. A PTC SIP compound according to claim 12, wherein the coupling agent is a linear siloxane oligomer having a mean molecular weight of 500-2500.

14. A multi-layered, zero-positive-zero temperature coefficient (ZPZ) foil comprising a composite body present between a first and second essentially planar metal foils, where the composite body is a PTC SIP compound according to claim 1, the composite body thereby forming a conductive network extending from the first metal foil to the second metal foil.

15. A multi-layered ZPZ foil according to claim 14, wherein the composite body has a volume resistivity of an order of magnitude exceeding 0.1 MΩcm.

16. A multi-layered ZPZ foil according to claim 14, further comprising a first intermediate layer formed at an interface located between the composite body and the first metal foil and a second intermediate layer formed at an interface located between the composite body and the second metal foil, each intermediate layer comprising an electrochemical pre-treatment.

17. A multi-layered device comprising:

an essentially two-dimensional composite body having a first major surface and a second major surface opposite to the first major surface, the composite body comprising:

an electrically insulating matrix consisting essentially of an elastomeric amorphous polymer, and a first and second types of electrically conductive particles dispersed within the matrix, wherein the second type of particles has a different surface energy and a different electrical conductivity than a surface energy and an electrical conductivity of the first type, the composite body thereby forming a conductive network extending from the first major surface to the opposite second major surface of the composite body, and a first electrode layer adhered to the first major surface of the composite body and a second electrode layer adhered to the second major surface of the composite body, each of the first and second electrode layers consisting of a metal foils prepared for connection to an electrodes carrying electrical current through the composite body in a direction essentially perpendicular to the first and second electrode layers.

18. A multi-layered device according to claim 17, wherein the amorphous polymer is a siloxane polymer.

19. A multi-layered device according to claim 17 comprising a multi-layered ZPZ foil, the composite body thereby forming a conductive network extending from the first metal foil to the second metal foil.

20. A multi-layered device according to claim 17 further comprising a first electrode connected to the first metal foil and a second electrode connected to the second metal foil, and a power supply to which the first and second electrodes may connect.

21. A multi-layered device according to claim 17, wherein the device is a heating element having a trip temperature between 25 and 170° C.

* * * * *

UNITED STATES PATENT AND TRADEMARK OFFICE

CERTIFICATE OF CORRECTION

PATENT NO. : 8,367,986 B2
APPLICATION NO. : 12/446187
DATED : February 5, 2013
INVENTOR(S) : Von Wachenfeldt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 955 days.

Signed and Sealed this
First Day of September, 2015

Michelle K. Lee

Michelle K. Lee
*Director of the United States Patent and Trademark Office*